US006655737B2

(12) United States Patent
Hyduk

(10) Patent No.: US 6,655,737 B2
(45) Date of Patent: Dec. 2, 2003

(54) STRAP ARRANGEMENT FOR A CHAIR

(76) Inventor: Michael A. Hyduk, 37 Aster Ct., Belle Mead, NJ (US) 08502

( * ) Notice: Subject to any disclaimer, the term of this patent is extended or adjusted under 35 U.S.C. 154(b) by 0 days.

(21) Appl. No.: 10/189,512

(22) Filed: Jul. 8, 2002

(65) Prior Publication Data

US 2003/0006634 A1 Jan. 9, 2003

Related U.S. Application Data

(60) Provisional application No. 60/303,717, filed on Jul. 9, 2001.

(51) Int. Cl.[7] ..... A47C 31/11
(52) U.S. Cl. ..... 297/229; 297/228.12; 297/228.13
(58) Field of Search ..... 297/219.1, 225, 297/228, 228.1, 228.12, 228.13, 229; 5/496, 498

(56) References Cited

U.S. PATENT DOCUMENTS

| | | | | | |
|---|---|---|---|---|---|
| 1,178,760 | A | | 4/1916 | Sorokin | |
| 2,149,247 | A | * | 2/1939 | Mesinger | 297/219.11 |
| 4,844,540 | A | | 7/1989 | Pegram | |
| 5,503,456 | A | | 4/1996 | Rossini | |
| 5,803,539 | A | * | 9/1998 | Dewar et al. | 297/228.12 |
| 5,829,832 | A | | 11/1998 | Molee et al. | |
| 5,960,520 | A | | 10/1999 | Conway et al. | |
| 6,447,059 | B1 | * | 9/2002 | Jackson et al. | 297/228.12 |

FOREIGN PATENT DOCUMENTS

| | | | | |
|---|---|---|---|---|
| NO | 97916 | * | 4/1961 | 297/228.13 |

* cited by examiner

*Primary Examiner*—Peter R. Brown

(57) ABSTRACT

A strap arrangement constituting a brace having a fan-shaped configuration formed of fixed or adjustable straps for retaining a covering such as a towel securely to a chair. The brace consists of four fixed or adjustable straps which are secured to the chair by suitable fasteners. The strap arrangement is useful for the convenience and enjoyment of a person at the beach, pool or patio.

11 Claims, 3 Drawing Sheets

STRAP ARRANGEMENT FOR A CHAIR

CROSS REFERENCE TO RELATED APPLICATIONS

This application claims the benefit of U.S. Provisional Application No. 60/303,717 filed Jul. 9, 2001.

BACKGROUND OF INVENTION

1. Field of the invention

The present invention relates to a strap arrangement constituting a brace having a fan-shaped configuration formed of fixed or adjustable straps for retaining a covering securely to a chair. The strap arrangement is useful for the convenience and enjoyment of a person at the beach, pool or patio.

2. Description of the Related Art

A chair cover, such as a towel, a blanket, a spread, a mat, or other such similar item that may be placed on the chair tends to reposition itself when the wind blows and/or other movements occur. Once positioned, the covering is readily subject to disarray from these movement effects. This results in reduced usage area of the covering as well as discomfort to the user. Throughout the years, a number of innovations have been developed which relate to solving these challenges. The following patents are considered representative of some of these innovations. U.S. Pat. No. 5,960,520 to Conway et al. uses a clip and a strap to attach to a chair made of tubular aluminum. Multiple straps/clips must be used at various positions and since the connecting strap is looped over the tubular perimeter, it cannot be secured tightly to the chair. There are several prior art patents directed to various methods of using fitted covers or pads. For example, U.S. Pat. No. 4,844,540 to Pegram provides straps attached to a covering which is placed over a chair. The covering must be custom made for each type and size of chair. U.S. Pat. No. 5,503,456 to Rossini uses a headrest which comprises three flexible, stretchable straps. U.S. Pat. No. 5,829,832 to Molee et al. uses a headrest wedged over a towel at the top of the chair. Such uses are limited as the opening must accommodate a wide variety of materials and chair designs and the opening in the headrest must provide sufficient gripping force to prevent it from "popping off" during use. It is also impractical for shorter people whose head is not positioned at the right level of the headrest.

The prior art, in general, discloses fitted covers for lounge chairs, but such specially designed covers would be needed for each type and size of chair.

U.S. Pat. No. 1,178,760 to Sorokin uses an arrangement of straps to keep an ironing board cover in place. It also uses springs to maintain tension and piercing clips to grab the fabric cover. These clips must perforate the cover which can cause wear and makes long term use impractical. This patent is directed to a non-analogous art and therefore is not considered anticipatory.

None of the above inventions and patents, taken singly or in combination, are seen to describe the instant invention as claimed.

SUMMARY OF THE INVENTION

A principle object of the present invention relates to a strap arrangement constituting a brace having a fan-shaped configuration formed of fixed or adjustable straps for retaining a covering such as a towel securely to a chair. The brace consists of four fixed or adjustable straps which are secured to the chair by suitable fasteners.

The present invention presents a solution to the repositioning movements of the chair covering. The present invention provides a solution wherein the brace is mounted on the top and back portions of the chair so that the covering fits securely to the chair. This prevents the wind from repositioning the covering. Further, the instant braced covering has a smooth and attractive appearance on the chair. The strap arrangement is mounted on the underside of the chair's back so that it does not interfere with the user. The strap arrangement can be either fixed in size or adjustable. The fixed strap arrangement fits most standard chairs and coverings. The adjustable strap arrangement fits substantially all chairs and coverings by varying the length of each strap to allow for a snug fit thereon.

Once adjusted for the chair and covering, the strap arrangement can be attached over and over to the chair in the same manner without further adjustments.

DETAILED DESCRIPTION OF THE INVENTION

The invention relates generally to a brace for retaining a covering securely to a chair. More specifically, the invention relates to a strap arrangement constituting a brace having a fan-shaped configuration formed of fixed or adjustable straps for retaining a covering securely to a chair. The brace consists of four fixed or adjustable straps which are secured to the chair by suitable fasteners.

As defined in this application, the term "covering" refers to a blanket, a spread, a mat, a towel-like covering and other such similar items.

Figure 1:
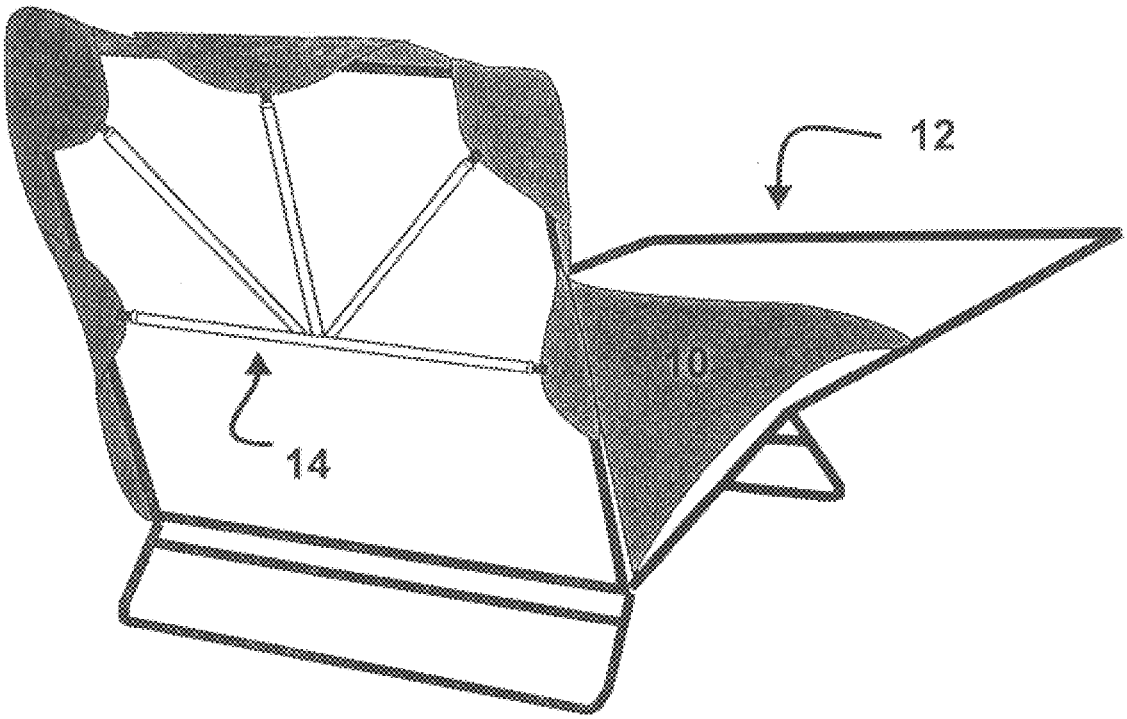
FIG. 1 is a perspective view of a strap arrangement constituting a brace having a fan-shaped configuration for retaining a covering securely to a chair, in accordance with the invention.
Figure 2:
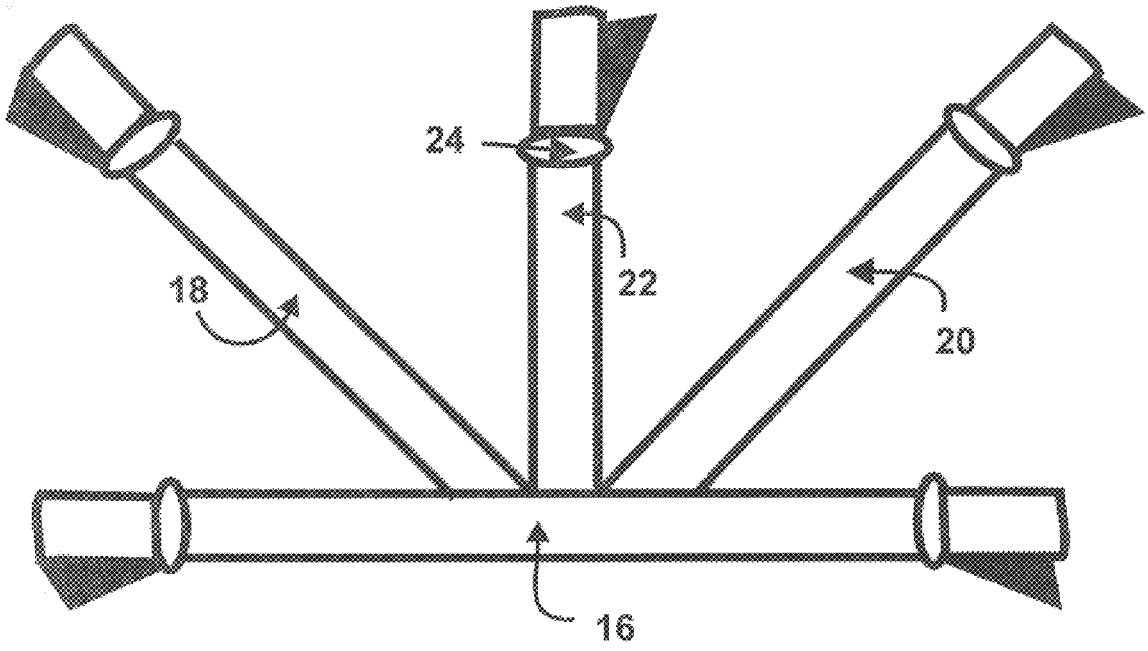
FIG. 2 is a top view of FIG. 1, showing the straps to be fixed or non-adjustable.
Figure 3:
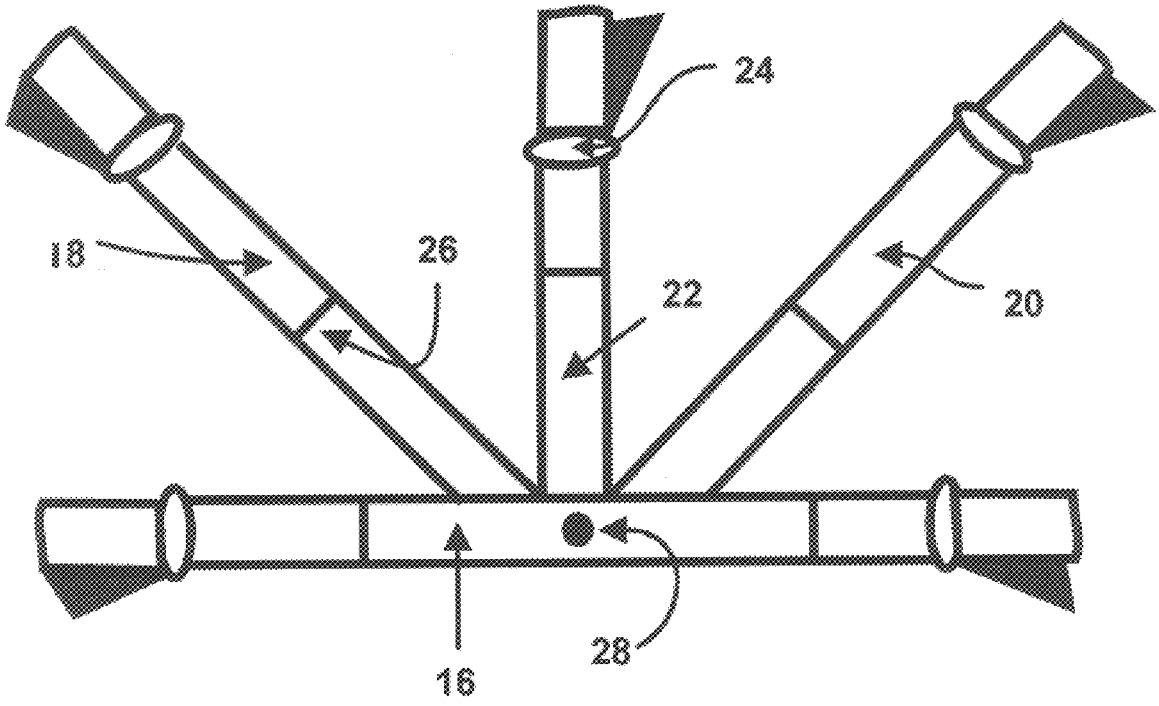
FIG. 3 is another top view of FIG. 1, showing the straps to be adjustable.

FIGS. 1–3 illustrate a strap arrangement constituting a brace or array 14 having a fan-shaped configuration formed of fixed or adjustable straps for retaining a covering 10. Reference numeral 14 refers generally to the various straps forming the brace structure. As illustrated in FIG. 1, the covering 10 substantially covers the appropriate areas of the front section of a chair 12 which constitutes a conventional beach, pool or patio type chair. The back section of the chair 12 has an upper portion, a lower portion, and a median portion located between the upper portion and a lower portion. The brace 14 that is mounted on the back section of the chair 12 consists of various straps that have been configured to be fan-shaped for providing strength and durability to the brace structure. The strap arrangement 14 includes a first strap 16, that has first and second ends, extends substantially horizontally at the approximate median section of the chair's back section. Each of the straps shown in FIG. 2 is fixed as to its respective length. The first end of the first strap 16 attaches to the covering 10. A second strap 18 and a third strap 20, each having first and second ends, extend upwardly at oblique angles from the mid-section of the first strap 16 to the upper portion of the covering 10 on the chair's back section. The respective first ends of the second and third straps, 18, 20, attach to the covering 10. A fourth strap 22 having first and second ends extends vertically upward from the mid-section of the first strap 16 to the upper portion of the covering 10 on the chair's back section. The first end of the fourth strap 22 attaches to the covering 10. The attachment ends of the first, second, third and fourth straps 16, 18, 20, 22 are firmly attached to the covering 10 by suitable fasteners, such as clips, toggles and the like. A hook and loop fastener such as Velcro™ may be used. Each of the straps shown in FIG. 2 is fixed as to its respective length. The second ends of the second, third and fourth straps 18, 20, 22 are firmly secured to the first strap 16. Each of the straps 16, 18, 20, 22 is secured to the strap arrangement 14 by being passed through a suitable opening in the strap attachment and the end stitched to the strap at the strap attachment.

Each of the straps shown in FIG. 3 is adjustable as to its respective length. The strap arrangement 14 is the same as described in FIG. 2 but each strap has an adjustment bar or buckle 26 to allow the length of the strap to vary to accommodate different size chairs and coverings. One end of each of the straps 16, 18, 20, 22 is passed through a suitable opening in the strap attachment 14 and secured to the strap adjustment buckle 26 by means of a suitable opening in the adjustment buckle 26 and the end stitched to the strap at the bar. Each of the adjustment buckles 26 slides along the strap and is locked in place by the user when the desired length is achieved. There is no need for straps 16, 22 to rotate and are therefore fixed in position.

Each of the straps 14 includes a conventional attachment ring 24. The strap arrangement 14 has been positioned on the chair's back section 50 that it does not interfere with actions by the user. The fixed straps fit most standard beach and patio chairs. Manipulating the individual adjustable straps 16–22 by respective adjustment buckles 26 allows the strap arrangement 14 to fit most beach, pool, and patio chairs. A rivet fastener 28 is mounted on the median section for securing the strap arrangement 14 to be an operative unity structure.

In summary, the present invention is directed to a strap arrangement constituting a brace having a fan-shaped configuration formed of fixed or adjustable straps for retaining a covering securely to a chair. The brace consists of four fixed or adjustable straps which are secured to the chair by suitable fasteners. The adjustable straps include a rivet member.

The strap arrangement of the present invention may be made of any suitable material that preferably is resistant to moisture. The strap arrangement may be made of any suitable color. In a similar manner, another strap arrangement could be used to secure the bottom portion of a covering to the chair's lower section, if desired.

The strap arrangement could be sold commercially with or without the covering. Accordingly, the addition or substraction of certain parts may be readily made and are considered within the scope of the invention.

While the invention has been particularly shown and described with reference to an embodiment thereof, it will be understood by those skilled in the art that various changes of form and detail may be made without departing from the spirit and scope of the invention.

What is claimed is:

1. A strap arrangement for a chair consisting of:

a chair having a frame;

the frame having a front section and a back section;

the back section having an upper portion, a lower portion and a median portion located between the upper portion and the lower portion;

a covering;

a fan-shaped configuration of straps secured to the covering on the frame; and including:

first strap member having first and second ends and extending substantially horizontally at the approximate median portion of the back section;

second and third strap members, each having first and second ends and extending upwardly at oblique angles from the median portion to the upper portion of the frame, respectively; and fourth strap member having first and second ends extending vertically upwardly from the median portion to the upper portion of the frame;

the first ends of the second, third and fourth strap members being firmly secured to the covering; and the second ends of the second, third and fourth strap members being firmly secured to the first strap member by a fastening means, respectively.

2. A strap arrangement for a chair according to claim 1, wherein each of the strap members is fixed as to its respective length.

3. A strap arrangement for a chair according to claim 1, wherein each of the strap members is adjustable as to its respective length.

4. A strap arrangement for a chair according to claim 3, wherein the adjustment of each of the strap members constitutes an adjustment buckle.

5. A strap arrangement for a chair according to claim 3, wherein the fastening means comprises a rivet member that is mounted on the approximate median portion of the back section for securing the respective adjustable strap members.

6. A brace for a chair having a back section, comprising:

a covering;

a fan-shaped configuration of straps secured to the covering on the chair;

the chair having a front section and a back section;

the back section having an upper portion, a lower portion and a median portion between the upper portion and the lower portion;

a covering;

a fan-shaped configuration of straps secured to the covering on the chair; and including:

first strap member having first and second ends and extending substantially horizontally at the approximate median portion of the back section;

second and third strap members, each having first and second ends and extending upwardly at oblique angles from the median portion to the upper portion of the chair, respectively; and fourth strap member having first and second ends extending vertically upwardly from the median portion to the upper portion of the chair;

the first ends of the second, third and fourth strap members being firmly secured to the covering, respectively; and the second ends of the second, third and fourth strap members being firmly secured to the first strap member, respectively.

7. A brace for a chair according to claim 6, wherein each of the strap members is fixed as to its respective length.

8. A brace for a chair according to claim 6, wherein each of the strap members is adjustable as to its respective length.

9. A strap arrangement for a chair according to claim 6, wherein the adjustment of each of the strap members constitutes an adjustment buckle.

10. A brace for a chair according to claim 6, wherein the fastening means comprises a rivet member that is mounted on the approximate median portion of the back section to allow the respective adjustable strap members to rotate.

11. A strap array for a beach chair having a back section, comprising:

a beach towel;

a fan-shaped configuration of straps secured to the beach towel on the beach chair;

the back section having an upper portion, a lower portion and a median portion between the upper portion and the lower portion;

the strap arrangement including:

first adjustable strap member having first and second ends and extending substantially horizontally at the approximate median portion of the back section;

second and third adjustable strap members, each having first and second ends and extending upwardly at oblique angles from the median portion, respectively; and fourth adjustable strap member having first and second ends extending vertically upwardly from the median portion on the back section, the first ends of the second, third and fourth strap members being secured to the covering, respectively;

the second ends of the second, third and fourth strap members being firmly secured to the first strap member, respectively; and the fastening means comprises a rivet member being mounted on the approximate median portion of the back section to allow the respective adjustable strap members to rotate;

the strap arrangement being useful for the convenience and enjoyment of a person at the beach.

* * * * *

UNITED STATES PATENT AND TRADEMARK OFFICE

CERTIFICATE OF CORRECTION

PATENT NO. : 6,655,737 B2
DATED : April 8, 2003
INVENTOR(S) : Marta Blumenfeld et al.

It is certified that error appears in the above-identified patent and that said Letters Patent is hereby corrected as shown below:

Column 188,
Lines 1-4, "2. The method according to claim 1, further comprising the step of: amplifying a portion of said purH gene comprising said biallelic marker prior to determining the identity of said nucleotide." should read -- 2. The method according to claim 1, further comprising the step of: amplifying a portion of said nucleic acid comprising said biallelic marker prior to determining the identity of said biallelic marker. --.

Lines 7-8, "4. The method according to claim 1, wherein said nucleotide is determined by performing a microsequencing assay." should read -- 4. The method according to claim 1, wherein the identity of said biallelic marker is determined by performing a microsequencing assay. --.

Lines 9-10, "5. The method according to claim 1, wherein said nucleotide is determined by performing a hybridization assay." should read -- 5. The method according to claim 1, wherein the identity of said biallelic marker is determined by performing a hybridization assay. --.

Lines 11-12, "6. The method according to claim 1, wherein said nucleotide is determined by performing a sequencing assay." should read -- 6. The method according to claim 1, wherein the identity of said biallelic marker is determined by performing a sequencing assay. --.

Signed and Sealed this

Sixth Day of September, 2005

JON W. DUDAS
*Director of the United States Patent and Trademark Office*